US005193472A

United States Patent [19]

Crossley

[11] Patent Number: 5,193,472

[45] Date of Patent: Mar. 16, 1993

[54] DUAL SLIDING NEEDLE BAR TUFTING APPARATUS

[75] Inventor: Philip H. Crossley, Blackburn, England

[73] Assignee: Spencer Wright Industries, Inc., Dalton, Ga.

[21] Appl. No.: 830,313

[22] Filed: Feb. 20, 1992

[30] Foreign Application Priority Data

May 15, 1991 [GB] United Kingdom ..... 9110506

[51] Int. Cl.[5] ..... D05B 15/30

[52] U.S. Cl. ..... 112/80.41; 112/80.45; 112/80.51

[58] Field of Search ..... 112/80.31, 80.4, 80.41, 112/80.5, 80.51, 80.52, 80.53, 80.54, 80.55, 166

[56] References Cited

U.S. PATENT DOCUMENTS

| | | | |
|---|---|---|---|
| 3,396,687 | 8/1968 | Nowicki | 112/80.4 X |
| 3,850,120 | 11/1974 | Jackson | 112/80.45 |
| 3,913,505 | 10/1975 | Crumbliss et al. | 112/80.53 |
| 4,003,321 | 1/1977 | CArd | 112/80.53 |
| 4,138,956 | 2/1979 | Parson | 112/80.45 X |
| 4,366,761 | 1/1983 | Card | 112/80.41 |
| 4,392,440 | 7/1983 | Ingram | 112/80.41 |
| 4,398,479 | 8/1983 | Czelusniak, Jr. | 112/80.41 |
| 4,465,001 | 8/1984 | Ingram | 112/80.41 |
| 4,483,261 | 11/1984 | Green et al. | 112/80.45 |
| 4,519,326 | 5/1985 | Green et al. | 112/80.45 |
| 4,574,716 | 3/1986 | Czelusniak, Jr. | 112/80.45 |
| 4,673,329 | 1/1987 | Czelusniak, Jr. | 112/80.45 |
| 4,800,828 | 1/1989 | Watkins | 112/80.41 |
| 4,903,624 | 2/1990 | Card et al. | 112/80.41 X |

*Primary Examiner*—Clifford D. Crowder
*Assistant Examiner*—Paul C. Lewis
*Attorney, Agent, or Firm*—Alan Ruderman

[57] ABSTRACT

A tufting machine has two slidable needle bars in back-to-back relationship, each needle bar being reciprocated toward and away from a backing material in unison. Each needle bar carries a plurality of transversely spaced apart needles mounted in needle modules, the needles in one bar being staggered relative to those in the other bar. The needles in both needle bars may cooperate with identical hooks positioned on the opposite side of the backing material. Each needle bar is slidable transversely independently of the other needle bar. The gauge between needles in each needle bar is twice the gauge between the hooks and the hooks have a common throat length so that each hook may cooperate with a needle in either needle bar. Thus each needle bar may be shifted transversely by a distance equal to the pitch between needles of the composite needle bar assembly rather than the larger pitch between needles in the same needle bar as in the prior art. This permits the gauge at which a particular yarn may be shifted to be substantially equal to half the gauge of that capable in the prior art so that substantially improved pattern definition may result.

11 Claims, 3 Drawing Sheets

DUAL SLIDING NEEDLE BAR TUFTING APPARATUS

BACKGROUND OF THE INVENTION

This invention relates to tufting machines and more particularly to a tufting machine having at least two sliding needle bars with the needles in each bar staggered relative to those in the others, the needle bars being capable of producing stitches at a gauge substantially less than the prior art.

In the production of tufted fabrics a plurality of spaced yarn carrying needles extend transversely across the machine and are reciprocated cyclically to penetrate and insert loops of yarn into a backing material fed longitudinally beneath the needles. The loops are seized by loopers or hooks oscillating below the fabric in timed relationship with the needles as the loopers or hooks cross the needles just above the needle eye. In loop pile machines the loopers point in the direction in which the backing material is being fed, hold the seized loops while the needles are being retracted from the backing, and thereafter move away from the point of seizure to release the loops. In cut pile machines the hooks point in the direction opposite to the direction in which the backing material is being fed so the loops are fed onto the hooks and each hook cooperates with a respective oscillating knife. Since the loops are fed toward the closed end of the hook they cannot be released except by being cut by the respective knife. As the hook rocks away from the point of loop seizure the knife rocks upwardly and cuts the loop. During each penetration of the backing material a row of pile is produced transversely across the backing material. Successive penetrations result in a longitudinal row of pile produced by each needle.

This basic method of tufting limits the aesthetic appearance of tufted fabrics so produced. Thus, the prior art has developed a number of procedures for creating various pattern effects.

One such procedure for patterning is to initiate relative lateral movement between the backing material and the needles to laterally displace longitudinal rows of stitching. One method is to jog or shift the needle bar endwise or laterally across the tufting machine relative to the base material in a step-wise manner in accordance with a pattern, that is the needle bar is slidable in the longitudinal direction thereof. The patented art is abound with disclosures relating thereto, and Ingram U.S. Pat. No. 4,392,440 is exemplary thereof.

The use of a single straight needle bar greatly constrains the versatility of a tufting machine thereby limiting the patterning capabilities. This versatility can be increased by using a laterally shiftable needle bar having staggered needles, i.e., a needle bar wherein adjacent needles are offset in the backing material feed direction. Staggered needle cut pile machines without a shiftable needle bar are illustrated in Crumbliss et al U.S. Pat. No. 3,913,505 and Card U.S. Pat. No. 4,003,321. When a shiftable or sliding needle bar is utilized with staggered needles a temporary crossing-over of adjacent yarns occurs thereby resulting in a greater variety of patterning effects.

It is also known to use two separately slidable back-to-back needle bars each having straight or side-by-side inline needles, i.e., one row of needles in each bar, so as to separate the two rows of needles of a staggered needle bar configuration onto separate needle bars which can be moved independently of one another to bring each needle into cooperative registration with a hook or looper at a given pitch position corresponding to the respective needle bar. This creates a much greater facility to cross one row of yarns and needles over the other row of yarns and needles to provide greater patterning effects.

As explained in the aforesaid Crumbliss et al U.S. Pat. No. 3,913,505 and the aforesaid Card U.S. Pat. No. 4,003,321, in conventional constructions, as used in the context of cut pile, the hooks cooperable with the needles in one row are of a different length than the hooks cooperating with the needles of the other row. That is, the throat length or distance from the bill to the neck of the hooks cooperating with needles of one row are of a different length than those of the hooks cooperating with the needles of the other row. Thus, in the prior art, as exemplified by Card U.S. Pat. No. 4,366,761, when there are two independent slidable needle bars or rows of needles, the hooks cooperating with a given needle bar can only cooperate with the needles in that bar. Thus, it is only possible to move a particular needle laterally by an amount consistent with a multiple of the pitch at which the needles are set on the relevant needle bar. That is to say each needle bar may only be shifted by an amount equal to a whole number multiple of the gauge or spacing of the needles in that needle bar, and which is twice the gauge of the composite needle bar assembly in dual shifting bars staggered needle tufting machines. This limitation manifests itself in a patterned tufted product as a lack of sharpness or definition in the pattern.

SUMMARY OF THE INVENTION

Consequently, it is the primary object of the present invention to provide a tufting machine having dual sliding needle bars each of which may be shifted laterally in a manner providing improved pattern definition.

It is another object of the present invention to provide a tufting machine having means permitting lateral shifting of each needle bar of a multiple shifting needle bar assembly by an amount equal to the pitch or gauge of the needle assembly as a whole, as distinct from that existing in relation to one of the needle bars, whereby reduced gauge results thereby to improve the sharpness or definition of the pattern in a product produced thereby.

It is a further object of the present invention to provide a tufting machine having at least two needle bars in close back-to-back relationship, each needle bar supporting a respective set of needles in uniformly spaced side-by-side relationship, the needle bars being movable laterally of the tufting machine for patterning purposes, and the loop seizing members having substantially common throat lengths for seizing loops from needles in either one or another of the needle bars.

Accordingly, the present invention provides a tufting machine having a plurality of slidable needle bars in back-to-back relationship with minimal clearance therebetween so that each needle bar may be shifted laterally relative to the movement of backing material through the machine, each needle bar carrying a multiplicity of spaced apart side-by-side needles and having loop seizing members, either hooks or loopers, each having substantially the same throat length so as to seize a loop of yarn from needles of any of the needle bars whereby the needle bars may be shifted laterally by a distance equal to the lateral pitch between needles of the composite needle bar assembly rather than the larger pitch between needles in the same needle bar, the latter being a limitation of the prior art.

In the preferred form of the invention there are two needle bars and each may be shifted by an amount substantially half the pitch between the needles in each bar. The back-to-back spacing between needles in the respective needle bar is minimized by the utilization of needles mounted in modules fastened to adjacent surfaces of the respective needle bars such that the back-to-back spacing between needles in the needle bars is approximately half of that in the prior art.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
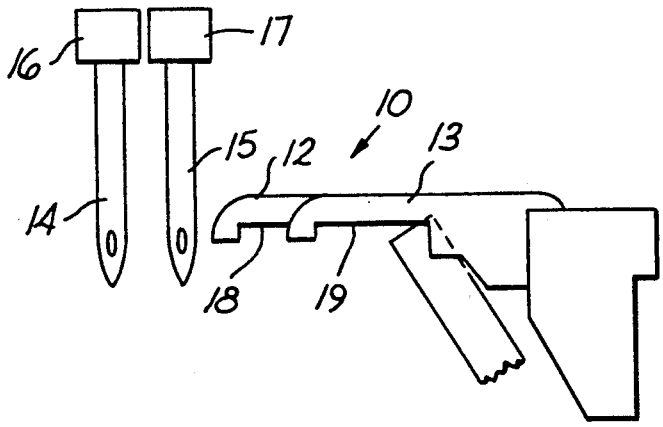
PRIOR ART FIG. 1
FIG. 1 is a diagrammatic depiction of the tuft-forming instrumentalities of the needle configuration of known prior art tufting machines having separately shiftable needle bars.
Figure 2:
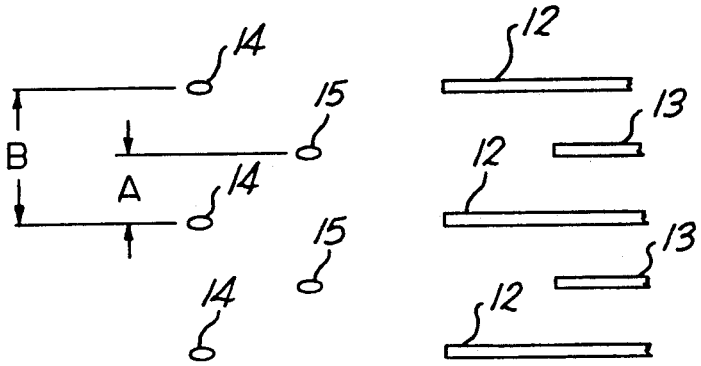
PRIOR ART FIG. 2
FIG. 2 is a diagrammatic depiction of the shifting potentialities of the construction illustrated in FIG. 1.

Referring now to the drawings, and more particularly to FIGS. 1 and 2, conventionally in a tufting machine having a double sliding needle bar arrangement, the loop takers 10, which in a cut pile machine are hooks, are provided as two plural sets 12, 13, each cooperating with respective plural sets or rows of needles 14, 15 of a respective needle bar 16, 17. The hooks in each set are the same but the two sets are different in that the length of the respective throats 18, 19 differ, the difference in length being such that the hooks 12 having the longer throats 18 are cooperable uniquely with the front row of needles 14 while the other hooks 13 have the shorter throats 19 and are cooperable only with the back row of needles 15, front and back rows being relative to the direction the backing material moves in a cut pile tufting machine, i.e., toward the neck at the closed end of the hooks.

As can be appreciated from FIG. 2, while the nominal pitch A of the needles in the two needle bars or rows when considered collectively is half of the pitch B of the needles on a given needle bar, needle shift must necessarily be a multiple of the pitch B of the needles on the needle bar being moved so as to cooperate with the relevant hook 12 or 13. Thus, any particular yarn carried by the respective needles only can be moved laterally by a distance which is a multiple of twice the nominal pitch of the needles as a whole.

The magnitude of such a shift militates against the provision of a sharp edge to a pattern, and this inevitably gives rise to a haziness or lack of definition of the pattern. In contradistinction to the prior art, the present invention provides a sharpness of pattern not attainable by prior art structures and gives rise to the creation of a more aesthetically pleasing patterned tufted product.

Figure 3:
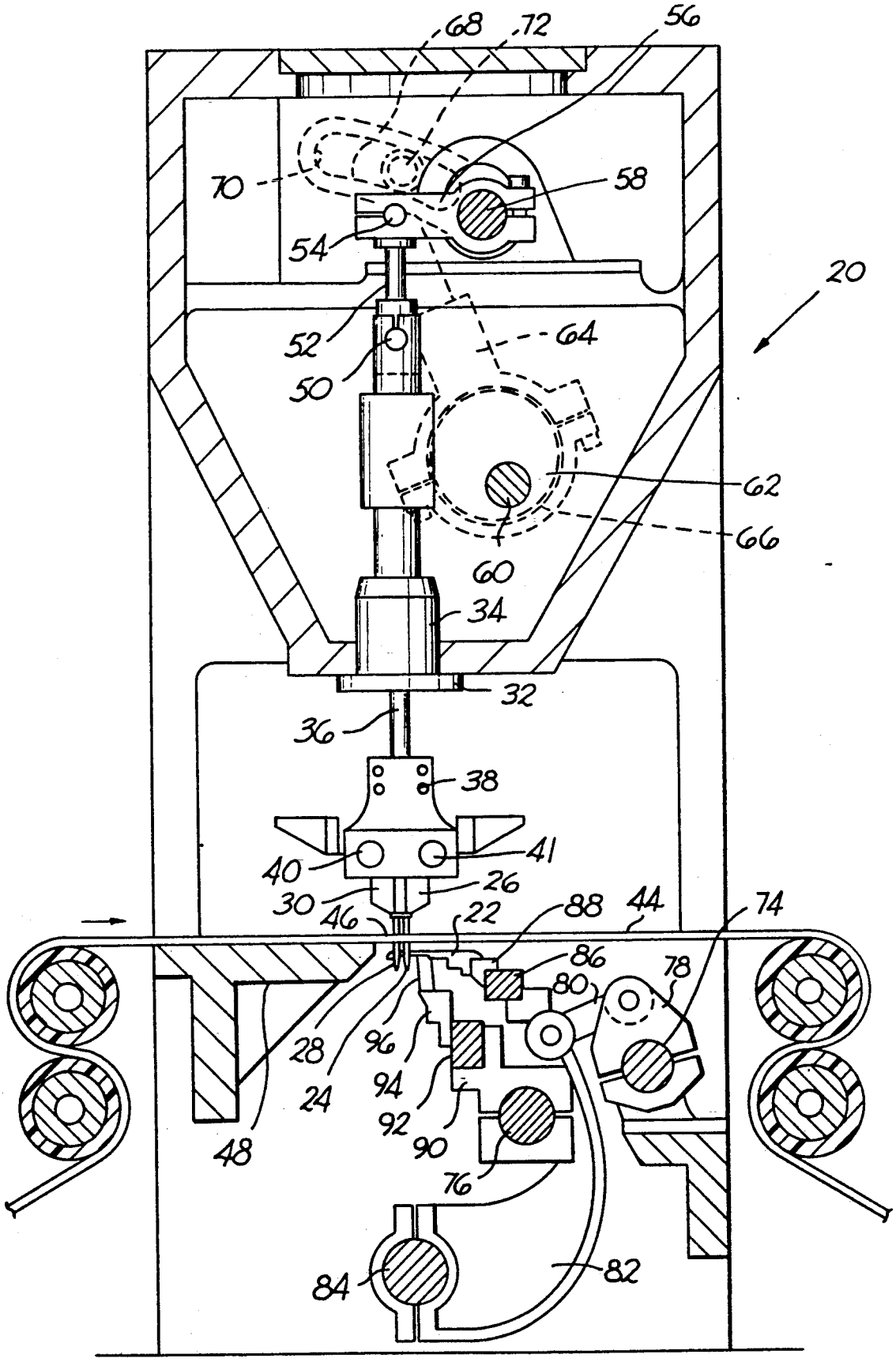
FIG. 3 is a vertical cross sectional view of a tufting machine incorporating apparatus constructed in accordance with the present invention.
Figure 4:
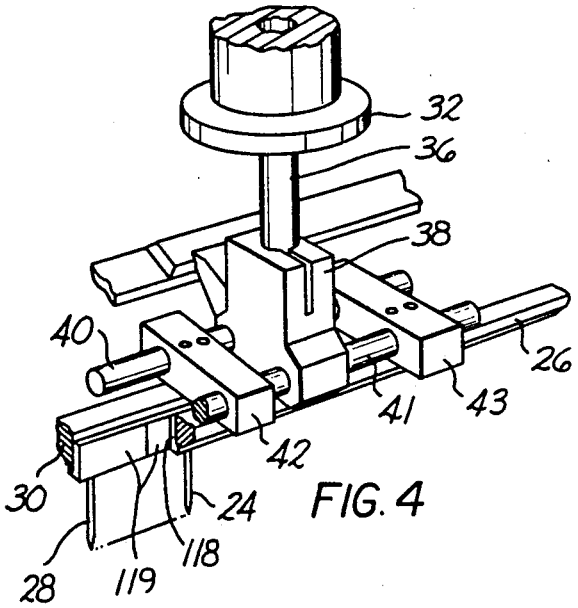
FIG. 4 is a fragmentary perspective view illustrating the mounting of the needle bars for lateral shifting of each needle bar relative to one of the reciprocating push rods.

Referring to FIG. 3, a tufting machine 20 constructed in accordance with the principles of the present invention is constructed so that all of the hooks 22 have throats of the same length and may cooperate with either the needles 24 mounted in the rear needle bar 26 or the needles 28 mounted in the front needle bar 30, each needle bar being laterally shiftable as hereinafter described relative to the direction in which backing material 44 is fed through the tufting machine. The tufting machine comprises a head within which is secured a plurality of collars 32, only one of which is illustrated for supporting respective sleeves 34. Journally disposed within each sleeve is a push rod 36. Attached to the lower end of the push rods is a support foot 38, the foot being a split member clamped about the respective push rod and secured thereto by screws or the like.

Figure 8:
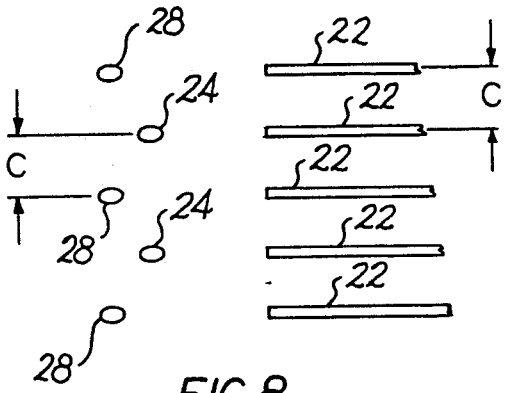
FIG. 8 is a view similar to FIG. 2 illustrating the reduced gauge attainable by the present invention.

Securely carried in each foot 38 lying in a plane substantially normal to the axis of each push rod is a pair of guide rods 40, 41, the rods being fixedly secured to each foot and therefore reciprocably movable together with the respective push rods 36. The rods 40, 41 are spaced apart and each is journally mounted in a respective linear bearing carried in a pair of laterally spaced apart slide blocks 42, 43, there preferably being one block adjacent each lateral side of the foot 38. One of the blocks, e.g. block 42 is secured to a first needle bar, e.g. front bar 30 and the other block 43 is secured to the other needle bar 26 by conventional means so that reciprocation of the push rods effects reciprocation of both needle bars and the needles carried therein. As the needle bar reciprocates the needles penetrate the backing material 44 fed across the needle plate fingers 46 on the bed plate 48 of the machine. Each needle bar carries a respective set 24, 28 of aligned needles which are staggered one row or needle bar relative to the other as illustrated in FIG. 8. Each needle 24, 28 cooperates with a respective loop taker, which in the embodiment illustrated comprises hooks 22 which cooperate with the needles for seizing loops of yarn as hereinafter further described. Lateral shifting of each needle bar results in the blocks 42, 43 moving along and relative to the guide rods, 40, 41, the shifting being effected by means hereinafter described.

The upper end of each push rod 36 is connected through a wrist pin 50 or the like to a link 52 which is in turn connected by another wrist pin 54 to a rocker arm 56 clamped to an oscillating mainshaft 58 so that rocking motion of the shaft 58 results in reciprocation of the needle bars 26, 30 and thus the needles 24, 28. Rocking motion is supplied to the mainshaft 58 through means including a camshaft 60 mounted in the head below and substantially parallel to the mainshaft and driven at one end of the machine by conventional means. A circular eccentric cam 62 is secured preferably adjacent each end of the camshaft and rotates there-with. A connecting rod 64 having a lower split end section is journalled on a sleeve 66 on the eccentric cam 62. The upper end of the connecting rod 64 is connected in a slotted arcuate lever arm 68 of a drive lever secured at one end to the mainshaft. The slot 70 within the arm has an arcuate path having a center of curvature coinciding with the geometric center of the eccentrically mounted cam when the cam is at bottom dead center. Thus, the stroke of the push rods 36 may be adjusted and this may be accomplished without changing the bottom position of the needle stroke. Accomplishing this merely involves repositioning a bolt 72 connecting the connecting rod 64 to the drive lever 68 within the slot which changes the amplitude of oscillation of the lever and effects a change in amplitude of rocking of the mainshaft 58 as is well known in the art.

A similar drive arrangement to that for driving the push rods 36 driven from the camshaft 60 acts to drive a hook jack shaft 74 and a knife shaft 76. A jack shaft rocker arm 78 is clamped to the jack shaft 74 and is pivotably connected at one end to a link 80 having its other end connected to the upper portion of a hook rocker arm 82 clamped at its lower end to an idler shaft 84 journalled in the bed of the tufting machine. The upper end of the hook rocker arm 82 carries a bar 86 which in turn carries the hook mounting bar 88-within which the hooks 22 are mounted in side-by-side relationship. A knife shaft rocker arm 90 is clamped to the knife shaft 76 and secures a knife bar 92 which carries the knife mounting blocks 94 in which the knives 96 are mounted. Conventionally the throw or oscillating movement of the hooks and the knives are controlled by adjustable means such as the slotted arm construction described in respect to the push rod reciprocation adjustments.

Figure 5:
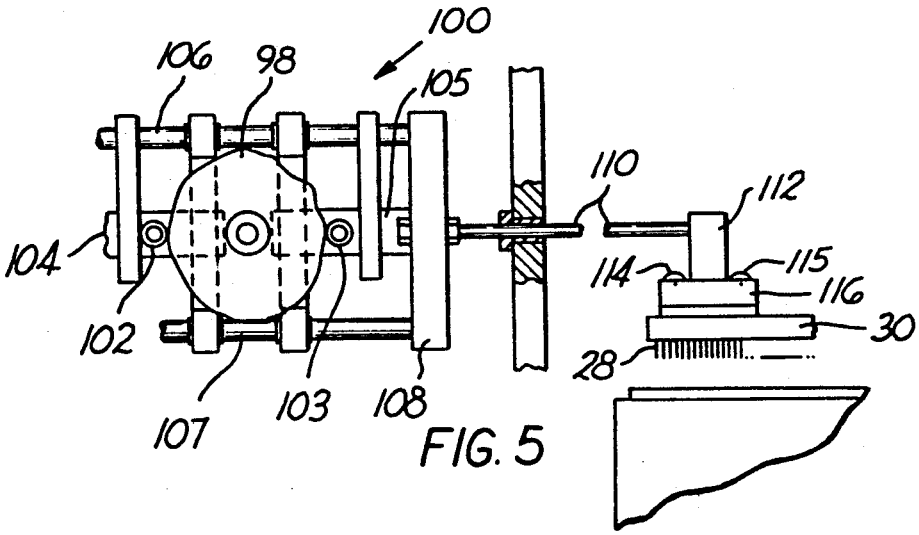
FIG. 5 is a diagrammatic view of a cam controlled shifter drive apparatus for shifting one of the needle bars relative to the push rods, there being a like apparatus for shifting the other needle bar.

Referring to FIG. 5, to shift each needle bar 26, 30 laterally a pattern cam 98 may be rotatably mounted in a shifter 100 drive assembly supported adjacent a respective end of the tufting machine, the assembly carrying followers carried on brackets 104, 105. There is, of course, one such assembly to drive each needle bar independently of the other needle bar. Each assembly may be similar to that illustrated in U.S. Pat. No. 4,465,001. The brackets 104, 105 are drivingly connected to slide rods 106, 107 fastened to another bracket 108 connected to a driving rod 110. The driving rod 110 is secured to a block 112 which is straddled by a pair of rollers 114, 115 carried by a bracket 116 which may be secured to the respective needle bar such as the bar 30 or other means secured to the needle bar so that the needle bar may reciprocate relative to the block 112 yet be moved laterally with the block as determined by the cam 98 and, of course, the needle bar when shifted laterally slides relative to the guide rods 40, 41 by means of the slide blocks 42, 43.

Figure 6:
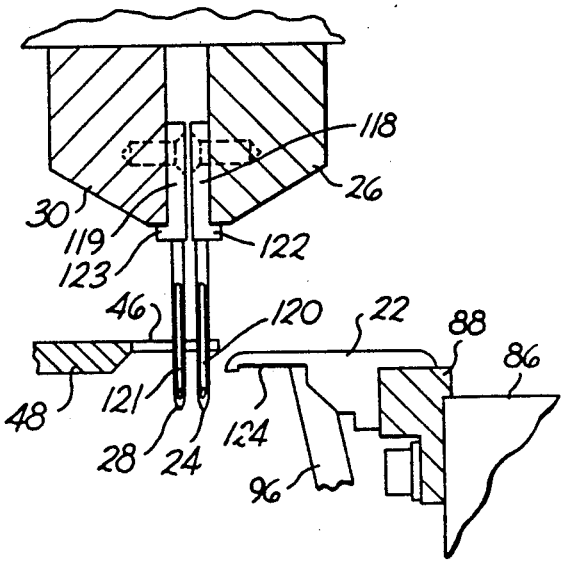
FIG. 6 is an enlarged fragmentary cross sectional view of the tuft forming instrumentalities illustrated in FIG. 3.

In accordance with the present invention the needles carried by each needle bar 26, 30 are embedded within a plurality of needle modules or modular blocks 118, 119, somewhat similar to those illustrated in U.S. Pat. No. 4,138,956, there being a substantial number such as, for example, 16 such needles embedded within each modular block 118, 119. As illustrated in the drawings the blocks 118, 119 are attached to facing surfaces of the respective needle bars 26, 30 by means of screws and are mounted back-to-back relative to one another so that the needles 24, 28 in the needle bars may be closely spaced to one another yet provide a clearance between the modular blocks 118, 119 to permit the needle bars to shift laterally relative to each other. To this end each needle module is identical but the needles are mounted such that the yarn grooves 120, 121 face the same end of the tufting machine as do the clearance above the eye (not illustrated). Each module has an abutment flange 122, 123 which faces remote from the other so the needles are embedded in the modules in opposite manner at a disposition remote from the respective flange as illustrated in FIG. 6. In the prior art, the spacing between the needles 14, 15 in FIGS. 1 and 2 is $\frac{1}{4}$ inch. However, with the construction according to the present invention, the needles in one bar may be spaced only $\frac{1}{8}$ inch from the needles in the other bar. Therefore, the hooks may all have the same length throat 124 extending from aligned necks 125 so that the throat length of the hooks may be equivalent to that of the smaller throat 19 of prior art hooks or a throat length somewhere between the short 19 and long throats 18 of the prior art hooks. Thus, the oscillation or throw of the hook arm 82 may increase slightly by the conventional adjusting means described so that a hook may seize a loop from needles in either needle bar.

Figure 7:
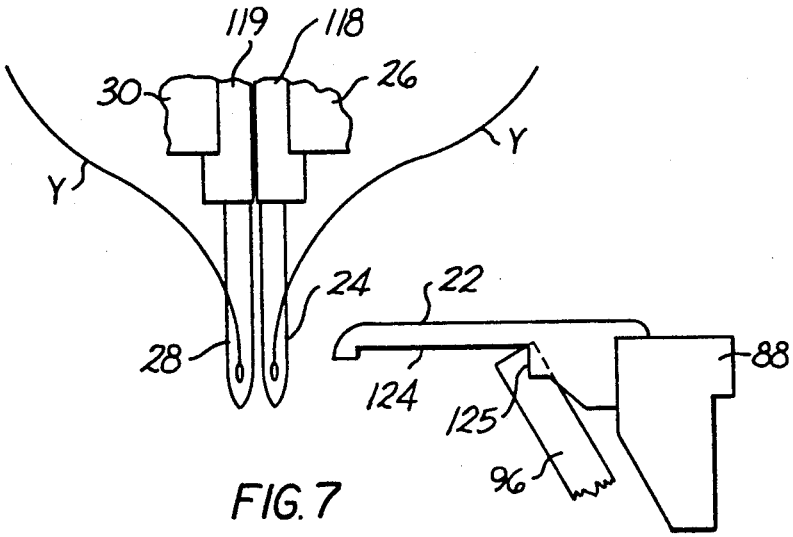
FIG. 7 is a view similar to FIG. 1 but of the needle and hook configuration of the present invention.

Thus, referring to FIGS. 7 and 8, with the needle bars arranged with the modules 118, 119 in closely spaced disposition in the direction of backing material feed, and the hooks having a common length sufficient to pick up loops from needles 28 mounted in the front needle bar 30 or needles 24 in the rear needle bar 26, the lateral shift of a yarn carrying needle may be a multiple of the pitch C of the needles as considered collectively in the double sliding needle bar arrangement, and may thus be equal to that pitch. Each shift made by each needle bar is not constrained by the unique throat length of the hooks since each hook has an identical throat length so each needle bar may be shifted a pitch equal to that of the hooks, which also is C. Consequently, the gauge at which a particular yarn may be shifted is substantially equal to half the gauge of that capable in the prior art so that clear pattern definition is obtainable.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A tufting machine comprising means for transporting a backing material for movement in a free direction extending longitudinally through said machine, a first elongated needle bar extending transversely relative to said feed direction carrying a first plurality of needles spaced apart transversely by a first distance, a second elongated needle bar extending transversely relative to said feed direction substantially parallel to said first needle bar carrying a second plurality of needles spaced apart transversely by a second distance, said first plurality of needles being disposed closely adjacent and always spaced a fixed distance from said second plurality of needs in said feed direction and always staggered relative to said second plurality of needles in said transverse direction, means for reciprocating said needle bars toward and away from said backing material to penetrate said backing material from one side thereof by said needles cyclically, loop seizing means disposed adjacent said backing material at a side opposite said one side for seizing loops of yarn presented by said needles, said loop seizing means comprising a plurality of loop seizing members in a single row in said transverse direction having throats of the same length spaced apart transversely by a distance substantially equal to the transverse distance between needles in said first and second needle bars considered as a composite, pattern controlled means operatively connected to said first and second needle bars to shift said needle bars transversely independently of each other by multiples of the spacing between adjacent loop seizing members, and means for oscillating adjacent loop seizing members into and out of loop seizing disposition with selected needles in alternate needle bars.

2. A tufting machine as recited in claim 1, wherein said first distance is equal to said second distance, and said loop seizing members are spaced apart by half of said first or second distance.

3. A tufting machine as recited in claim 2, wherein said loop seizing members are cut pile hooks having aligned necks.

4. A tufting machine as recited in claim 1, wherein said means for reciprocating said needle bars drives both said needle bars in unison.

5. A tufting machine as recited in claim 1, wherein said needles in each of said first and second needle bars are mounted within a plurality of needle modules, each needle module supporting a number of needles, the needle modules of said first needle bar being mounted on a surface thereof disposed adjacent to and facing said second needle bar, and the needle modules of said second needle bar being mounted on a surface thereof disposed adjacent to and facing said first needle bar, the needles in all of said modules having the same transverse disposition.

6. A tufting machine as recited in claim 2, wherein said means for reciprocating said needle bars drives both said needle bars in unison.

7. A tufting machine as recited in claim 6, wherein said needles in each of said first and second needle bars are mounted within a plurality of needle modules, each needle module supporting a number of needles, the needle modules of said first needle bar being mounted on a surface thereof disposed adjacent to and facing said second needle bar, and the needle modules of said second needle bar being mounted on a surface thereof disposed adjacent to and facing said first needle bar, the needles in all of said modules having the same transverse disposition.

8. A tufting machine as recited in claim 5, wherein said first distance is equal to said second distance, and said loop seizing members are spaced apart by half of said first or second distance.

9. A tufting machine as recited in claim 4, wherein said needles in each of said first and second needle bars are mounted within a plurality of needle modules, each needle module supporting a number of needles, the needle modules of said first needle bar being mounted on a surface thereof disposed adjacent to and facing said second needle bar, and the needle modules of said second needle bar being mounted on a surface thereof disposed adjacent to and facing said first needle bar, the needles in all of said modules having the same transverse disposition.

10. A tufting machine as recited in claim 5, wherein each of said needles has a yarn groove, and the yarn groove of said needles in said first and second needle bars all face transversely in the same direction.

11. A tufting machine as recited in claim 1, wherein the needles in said first needle bar are spaced from the needles in said second needle bar in said feed direction by a distance substantially equal to $\frac{1}{8}$ inch.

* * * * *

UNITED STATES PATENT AND TRADEMARK OFFICE

CERTIFICATE OF CORRECTION

PATENT NO. : 5,193,472

DATED : March 16, 1993

INVENTOR(S) : Philip H. Crossley

It is certified that error appears in the above-identified patent and that said Letters Patent is hereby corrected as shown below:

Claim 1, column 6, line 63, "needs" should be
-- needles --

Signed and Sealed this

Twenty-third Day of November, 1993

*Attest:*

Bruce Lehman

BRUCE LEHMAN

*Attesting Officer*

*Commissioner of Patents and Trademarks*